United States Patent [19]

Majthan et al.

[11] 4,300,280

[45] Nov. 17, 1981

[54] HAIR DRYER AND METHOD FOR PRODUCING A HEATING ELEMENT THEREFOR

[75] Inventors: Rudolf Majthan, Schwalbach; Rolf Stühler, Wi-Delkenheim, both of Fed. Rep. of Germany; Raymond G. Parsonage, Maidenhead; Charles C. Packham, Wockingham, both of United Kingdom

[73] Assignee: Braun A.G., Kronberg, Fed. Rep. of Germany

[21] Appl. No.: 133,740

[22] Filed: Mar. 25, 1980

[30] Foreign Application Priority Data

Aug. 26, 1978 [DE] Fed. Rep. of Germany ..... 2837316

[51] Int. Cl.[3] ..... H05B 3/00

[52] U.S. Cl. ..... 29/611; 219/546; 219/547

[58] Field of Search ..... 29/611, 619; 219/546, 219/547, 370; 338/302

[56] References Cited

U.S. PATENT DOCUMENTS

| | | | |
|---|---|---|---|
| 2,864,929 | 12/1958 | Schwing | 219/546 X |
| 3,680,207 | 8/1972 | Belmonte et al. | 29/611 |
| 3,904,851 | 9/1975 | Gustafson | 219/546 |
| 4,092,626 | 5/1978 | Bergersen | 29/611 X |
| 4,100,673 | 7/1978 | Leavines | 29/611 |

FOREIGN PATENT DOCUMENTS

| | | |
|---|---|---|
| 1557256 | 4/1970 | Fed. Rep. of Germany . |
| 2307066 | 8/1974 | Fed. Rep. of Germany . |
| 2530075 | 1/1977 | Fed. Rep. of Germany . |
| 2206919 | 12/1974 | France . |
| 1525179 | 9/1978 | United Kingdom . |

*Primary Examiner*—Leon Gilden

*Attorney, Agent, or Firm*—Sughrue, Mion, Zinn, Macpeak and Seas

[57] ABSTRACT

An axially compact hair dryer includes a cylindrical outer housing 1, an air outlet 2 at one end of the housing, an air inlet grate 3 at the other end, an electric motor 4 centrally mounted within the housing and driving a blower fan 5, and a generally cylindrical electric heating element 7 disposed in the otherwise wasted annular space between the motor and the housing.

3 Claims, 11 Drawing Figures

HAIR DRYER AND METHOD FOR PRODUCING A HEATING ELEMENT THEREFOR

BACKGROUND OF THE INVENTION

The invention relates to a hair dryer with a fan driven by an electric motor and an electric heating element. Furthermore, the invention concerns a procedure for producing the heating element for this hair dryer.

Hair dryers of the type mentioned above have been in general use for many years. Such hair dryers should be made as light and compact as possible so as to make them comfortable to use. The small dimensions are necessary, because hair dryers are often taken along on trips and should then take up as little luggage space as possible.

Customary hair dryers have their electric heating elements behind the fan and in front of the air outlet. This necessitates considerable distance between the fan and the end of the air outlet to accommodate the heating element and to give the air stream sufficient time to circulate intensively to eliminate air streams of widely varying temperatures.

Providing electric heating of the fan blades has already been suggested. Such a fan would require no more space in the hair dryer than is required by the fan itself. The air passes rapidly over the fan blades. The heat transfer is very good so that the heating surface can be small and the heating temperature can be low. The heated air is well mixed by the fan and subsequently in the outlet so that no temperature streams arise. The disadvantage associated with this suggestion lies in the fact that the use of such a specialized fan makes the hair dryer expensive.

SUMMARY OF THE INVENTION

The object of the invention is to produce a hair dryer which is as compact and light as possible, has uniform air temperature and is economical to produce. An additional object is to provide an economical method of producing a heating element for the hair dryer taught in the invention.

The first object mentioned above is achieved according to the invention by locating the electric heating element around the outside of the electric motor.

In hair dryers having axial air passages, the fan determines the diameter of the housing, based on the necessary fan output. Behind the fan, between the motor and the housing, there is an annular space, which has remained unused up to now. The invention uses this annular space to accommodate the electric heating element. Thus, the hair dryer in the invention can be built very compact. Since the air moves rapidly through this annular space, good heat transfer from the heating element to the air is possible. This allows the electric heating element to operate under high surface area load. The high air speed also prevents the hair dryer housing, which is normally made of plastic, from overheating.

It is desirable to make the support body for the heating element out of a material with as low a heat retention capacity as possible. Practice has shown that when the material known as Mekanite is used, the heat retention capacity of the heating element is so low that the fan moves enough air over the heating element after the hair dryer is switched off to cool the heating element sufficiently to prevent overheating of the housing. Mekanite is a micaceous material with a silicon binder.

Preferably, the electric heating element has a hollow cylindrical support body.

The heating wire or the heating coil extends into the flow section between the electric motor and the housing and thereby facilitates efficient heat transfer. This is especially true when the support body is a cylinder whose outer surface is provided with several overlapping groups of slots following a spiral line. A heating coil, which is wrapped cordlike around the cylinder, extends through these slots into the inside of the cylinder.

An air directing wheel is disposed inside the hair dryer housing in front of the fan. This makes it possible to direct the air stream in an axial direction behind the fan before reaching the fan, and enables the fan to be mounted with a very short cantilever shaft.

The electric heating element is held between two support grates which are secured inside the hair dryer housing, and the support grate on the air intake side also serves as a mount for the electric motor.

A separate outlet grate can be spared if the support grate on the air outlet side also serves as the outlet grate. A particularly efficient yet economical model can be constructed if the heating element is as long as the electric motor and if both support grates serve as mounts for the heating element and the electric motor.

If an air directing wheel is provided between the fan and the electric heating element, a particularly uniform axial flow is achieved in the annular space between the electric motor and the housing. This assures very uniform temperature distribution in the air emitted by the hair dryer.

It is advantageous for the air directing wheel to be attached to the support grate on the outlet side of the electric heating element.

Because the heating element is disposed around the electric motor, only short distances from the heating body must be bridged to provide current to the electric motor. It is thus possible to supply current to the motor by means of a contact strip directly attached to the wrapping of the electric heating element.

Another feature provides for a lead plate with an integral circuit breaker switch for the electric heating element. The lead plate is situated in the handle of the housing and corresponds roughly to the shape of the inside of the housing. This places the circuit breaker switch at a safe distance from the heating element, whereby the housing is effectively protected and any unnecessarily premature breaking of the circuit is also avoided.

The support body is most advantageously constructed as a flat strip of material which is bent into a cylinder after being wrapped with heating wire as wrapping is done mechanically much easier on the flat strip of material than on a closed cylinder.

In another embodiment, the support body is held together by two attachment rivets, which, on the one hand, hold together the two ends of the material shaped into a cylinder, and, on the other hand secure the heating wire and the wire attached to it. Thus the attachment rivets have a double function, serving as fastening elements for the support body bent out of a strip of material, and as attachment clamps for the electric leads.

Preferably, the attachment rivets have two V-shaped arms angled away from the support body. The heating wire and the connecting wire can be attached to respective arms.

To achieve the necessary flexibility in the flat strip of material used to form the cylindrical support body, it is advantageous to bend the flat strip of material between two rollers before finally bending it into a cylinder, and then to flatten it out again to wind the heating wire thereon. Practice has shown that the preferred material Mekanite is too rigid to be formed into the desired cylindrical shape without such prior bending.

The heating element can also be produced by making the support body out of support plates, each of which is part of the surface of a prismatic column, and wrapping the outside of the support body with a heating wire.

The housing and the electric motor are especially well protected against heat since the heating wire is wrapped axially around the outer surface of a first support body and around the inner surface of a second support body which coaxially surrounds the first support body.

The procedure according to the invention for producing a cylindrical, electric heating for hair dryers is characterized by the following steps:

(a) bending a flat strip of Mekanite material between two rollers,
(b) flattening the bent strip of material again,
(c) transversely wrapping the strip of material with a heating wire, and
(d) bending the strip of material with the heating wire wrapping into a cylinder.

This process makes the brittle strip material sufficiently flexible so that after being wrapped with heating wire it can be given the desired cylindrical form. This bending is simplified if at least one of the two rollers is longitudinally fluted. This fluting forms slight waves in the strip of material, thus making it easier to bend it to the predetermined shape. Highly uniform bending during the formation of the cylindrical support body can be achieved by placing the strip of material between two thin metal sheets and bending it with a roller.

DETAILED DESCRIPTION OF THE PREFERRED EMBODIMENTS

Figure 1:
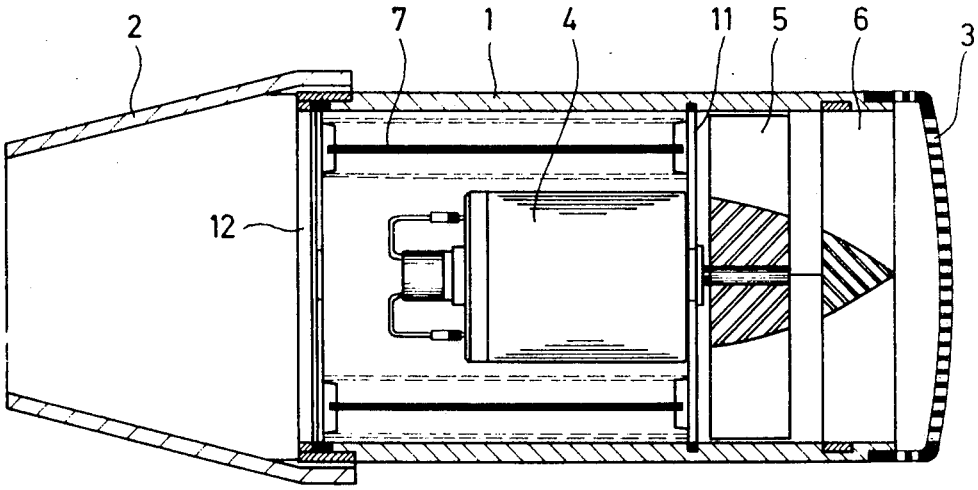
FIG. 1 is a longitudinal section through a hair dryer constructed according to the invention.
Figure 2:
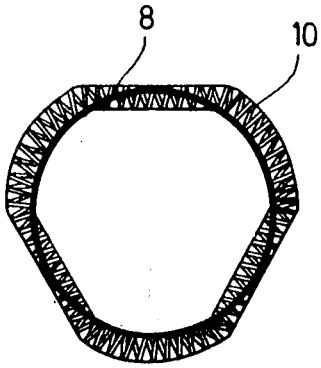
FIG. 2 is a cross section through the heating element of the hair dryer according to FIG. 1.
Figure 3:
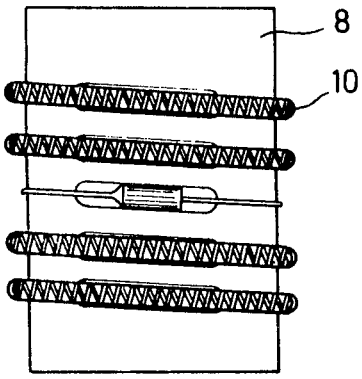
FIG. 3 is a top view of the heating element of the hair dryer according to FIG. 1.
Figure 4:
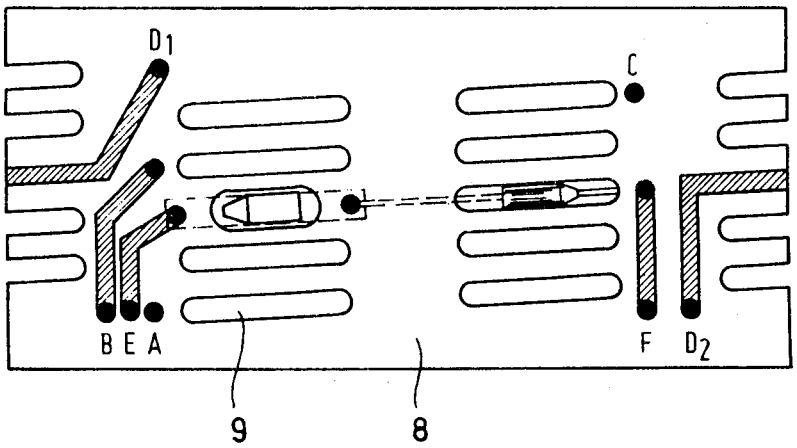
FIG. 4 is the support body for the heating element according to FIG. 1 shown unwound.

FIG. 1 shows a housing 1 of a hair dryer with an air outlet 2 and an air inlet grate 3. In the housing 1 there is an electric motor 4 which drives a fan 5. An air directing wheel 6 is situated between the fan 5 and the air inlet grate 3, and creates a well directed axial flow behind the fan between the housing 1 and the motor 4. A heating element 7 is disposed in the annular space between the motor 4 and the housing 1, as depicted in detail in FIGS. 2, 3 and 4. The heating element 7 has a support body 8 made of an electric insulation material with a low heat retention capacity, e.g. Mekanite. This support body is shaped as a hollow cylinder and has, as shown in FIG. 4, three groups of overlapping slots 9. These slots are located along a spiral line, so that a heating coil 10 extends into the slots when it is coiled around the outside of the support body 8. The slots 9 allow the heating coil 10, as shown in FIG. 2, to extend inside the support body 8 so that the air flowing past the motor 4 on the outside comes into contact with the heating coil 10 on the inside, thus assuring good heat transfer.

The heating element 7 is attached inside the housing 1 by means of two support grates 11 and 12. The support grate 11, which faces the air inlet grate 3, simultaneously serves as a support for the electric motor 4.

Figure 5:
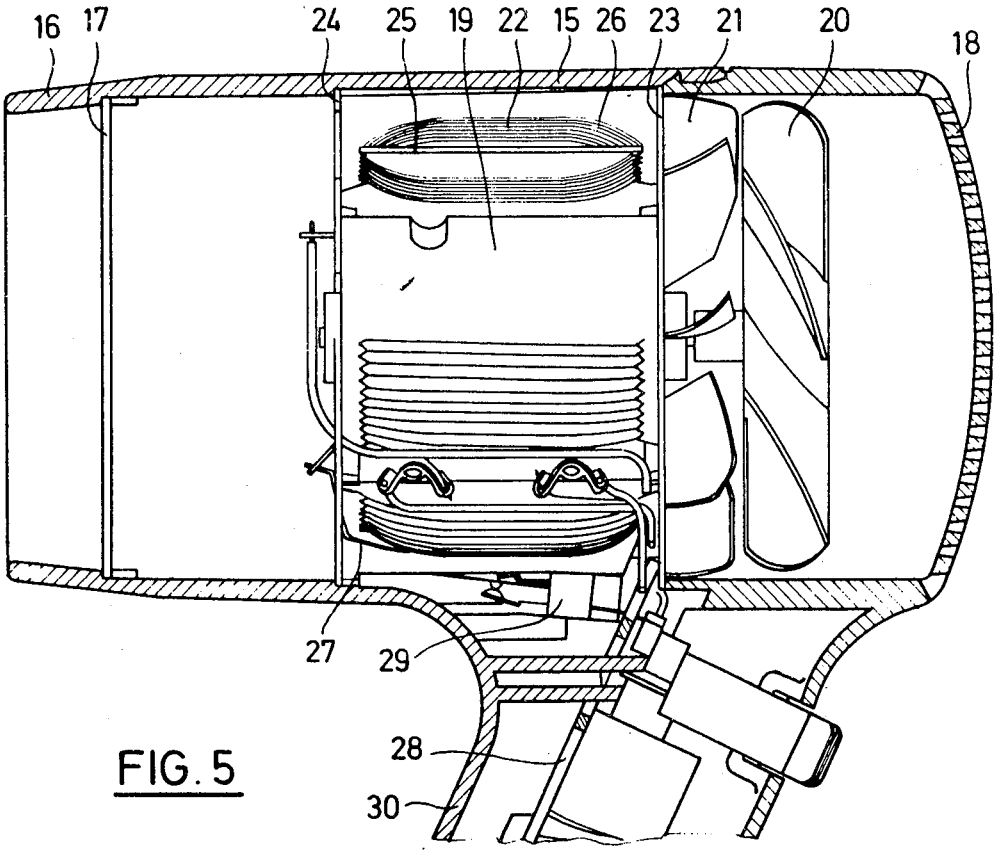
FIG. 5 is a longitudinal section through a second embodiment of a hair dryer according to the invention.

The embodiment according to FIG. 5 shows a hair dryer having a housing 15 with an air outlet 16. An air outlet grate 17 is situated in front of the outlet 16 inside the housing, which prevents the user from reaching into the housing. On the opposite end of the housing, an air inlet grate 18 is provided, through which ambient air enters the hair dryer. An electric motor 19 inside the housing 15 drives a fan 20. An air directing wheel 21 is situated between the fan 20 and the electric motor 19. The air blown by the fan 20 is directed by the wheel 21 so that it flows axially through the annular space between the electric motor 19 and the housing 15. An electric heating element 22 is located in this annular space and is supported by two support grates 23, 24. The support body 25 for the heating element 22 is a hollow cylinder, around which the heating wire 26 is wound. The heating wire 26 in the depicted embodiment is wound according to German OS No. 25 30 075.

FIG. 5 also shows a contact strip 27 which is connected to the heating wire 26 and also leads directly to the electric motor 19. This feature is more clearly visible in FIG. 7.

FIG. 5 also shows a circuit breaker switch 29 mounted on a lead plate 28 in the handle 30 of the hair dryer. This circuit breaker switch 29 serves to cut off the current if the heating element 22 should overheat. It is located inside the housing 15 at the place where overheating damage is most likely to occur.

Figure 6:
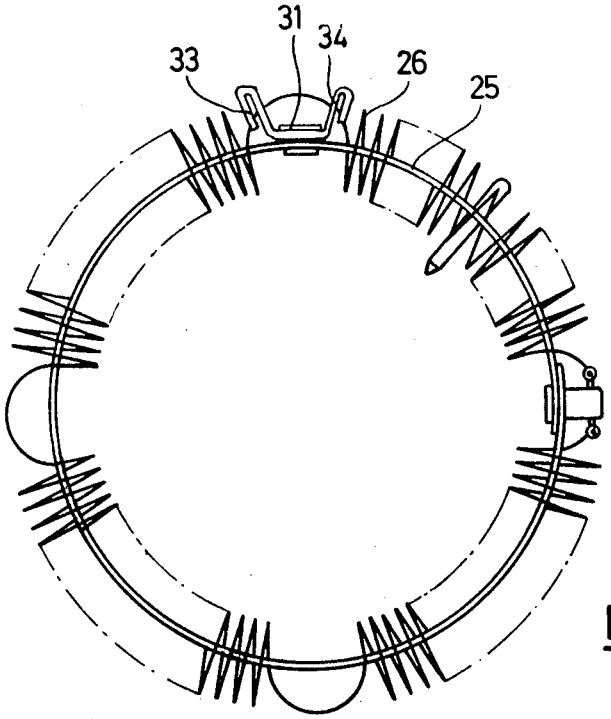
FIG. 6 is a cross section through the heating element of the hair dryer according to FIG. 5.
Figure 7:
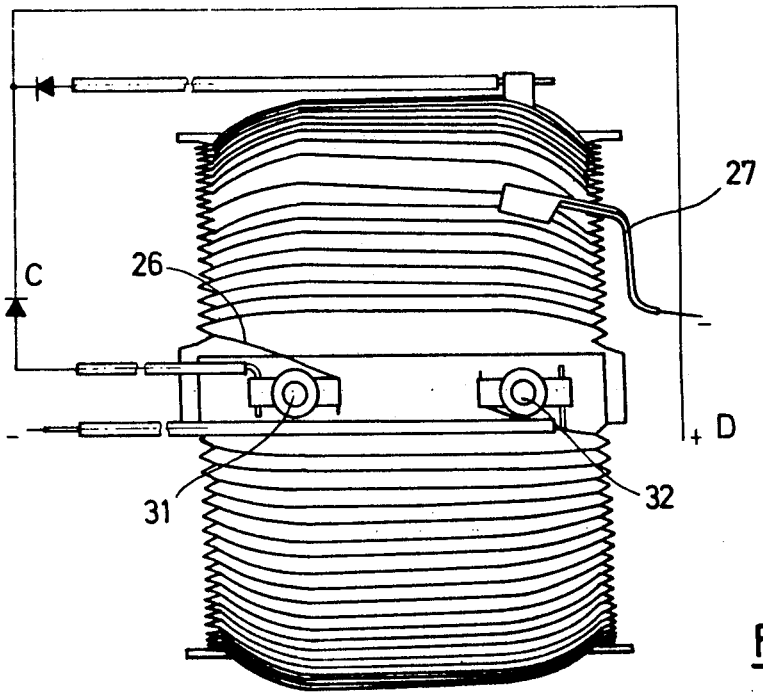
FIG. 7 is a top view of the heating element according to FIG. 6.

As shown in FIGS. 6 and 7, the support body 25 is bent from a strip of material held in cylindrical shape by two connecting rivets 31, 32. These rivets not only hold the support body together, they also securely hold the heating wire 26 and the lead to the heating element.

Figure 8:
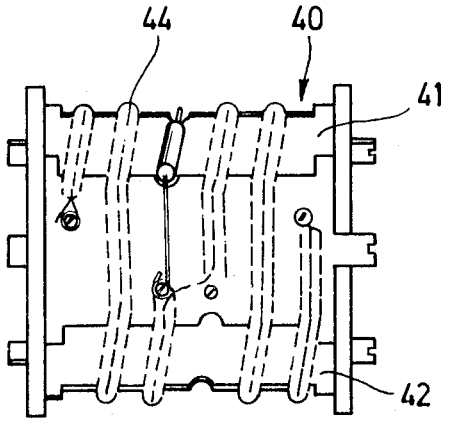
FIG. 8 is a top view of another embodiment of a heating element for a hair dryer constructed according to the invention.
Figure 9:
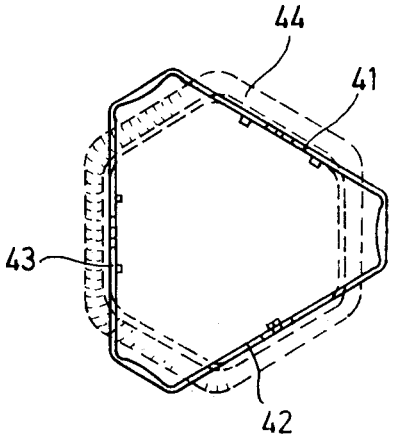
FIG. 9 is a side view of the heating element according to FIG. 8.

FIGS. 8 and 9 show a further embodiment of the heating element having a support body 40 formed of three support plates 41, 42, and 43. The support plates form parts of the surface of a prismatic column, which is wrapped on the outside by a heating coil 44. Since the support plates 41, 42, 43 represent only partial surfaces, the heating coil 44 extends into the inside of the triangular cross section formed by plates 41, 42, 43 so that good contact is assured between the air stream and the heating coil 44.

Figure 10:
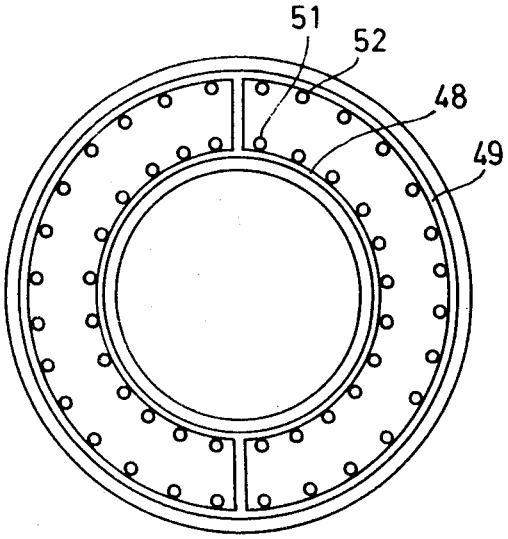
FIG. 10 is a side view of a further embodiment of a heating element according to the invention.
Figure 11:
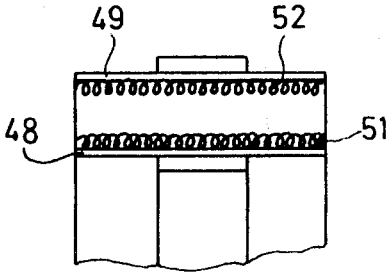
FIG. 11 is a section through the upper part of the heating elememt according to FIG. 10.

FIGS. 10 and 11 show another heating element embodiment consisting of a first hollow cylindrical support body 48 surrounded by a second such body 49. Heating coils 51 are arranged on the outer surface of the first support body 48 longitudinally along its length. Corresponding heating coils 52 are found on the inner surface of the outer support body 49. The heating element according to FIGS. 10 and 11 is arranged in the hair dryer housing so that the air to be heated flows only between the two support bodies 48, 49. This gives particularly good overheating protection to the electric motor and the hair dryer housing.

What is claimed is:

1. A method for making a cylindrical electrical heating element for hair dryers, comprising the following steps:

(a) bending a flat strip of material made of Mekanite between two rollers, (b) flattening the bent strip of material, (c) transversely wrapping a heating wire around the strip of material, and (d) bending the strip of material with the heating wire wrapped therearound into a cylinder.

2. Method according to claim 1, wherein at least one of the two bending rollers is longitudinally fluted.

3. Method according to claim 1, wherein the strip of material is placed between two sheets of metal and then bent with a bending roller.

* * * * *